US007159977B1

(12) United States Patent
Putman et al.

(10) Patent No.: US 7,159,977 B1
(45) Date of Patent: Jan. 9, 2007

(54) TRANSPORT PROTECTOR FOR AN INKJET CARTRIDGE

(75) Inventors: William Allen Putman, Franklin, TN (US); Stephen Abb Anderson, Thompson's Station, TN (US)

(73) Assignee: Nu-Kote International, Inc., Franklin, TN (US)

( * ) Notice: Subject to any disclaimer, the term of this patent is extended or adjusted under 35 U.S.C. 154(b) by 278 days.

(21) Appl. No.: 10/872,854

(22) Filed: Jun. 21, 2004

(51) Int. Cl.
*B41J 29/13* (2006.01)
*B41J 2/175* (2006.01)
*B41J 2/165* (2006.01)

(52) U.S. Cl. ..... 347/108; 347/86; 347/29

(58) Field of Classification Search ..... 347/108, 347/49, 85, 86, 87, 29, 31; 206/204, 576
See application file for complete search history.

(56) References Cited

U.S. PATENT DOCUMENTS 5,365,262 A 11/1994 Hattori et al.
5,373,936 A * 12/1994 Kawai et al. ..... 206/204
5,537,134 A 7/1996 Baldwin et al.
5,748,216 A 5/1998 Scheffelin et al.
5,933,175 A 8/1999 Stathem et al.
6,095,643 A 8/2000 Cook et al.
6,328,424 B1 12/2001 Denton et al.
6,634,732 B1 10/2003 Farr et al.

* cited by examiner

*Primary Examiner*—Shih-Wen Hsieh
(74) *Attorney, Agent, or Firm*—Fay, Sharpe, Fagan, Minnich & McKee, LLP

(57) ABSTRACT

A transport protector is provided for an inkjet cartridge wherein the inkjet cartridge includes a cartridge body, an inkwell extending from the cartridge body and a nozzle on the inkwell. The protector includes a protector body having a recess shaped to receive an inkwell of an inkjet cartridge and cover a nozzle of the inkjet cartridge. The protector further including a lid hingedly connected to the body. The lid pivots between an opened condition and a closed condition and engages the inkjet cartridge to evenly urge the cartridge into the recess when in the closed condition. The lid also includes a lid lock for releasably engaging the protector body to maintain the protector in the closed condition.

39 Claims, 5 Drawing Sheets

TRANSPORT PROTECTOR FOR AN INKJET CARTRIDGE

The present invention relates to the art of packaging and, more particularly, to a transport protector for protecting an inkjet cartridge during shipping and/or handling.

INCORPORATION BY REFERENCE

The present invention relates to protecting inkjet cartridges. Scheffelin U.S. Pat. No. 5,748,216; Hattori U.S. Pat. No. 5,365,262; Denton U.S. Pat. No. 6,328,424; Cook U.S. Pat. No. 6,095,643; Baldwin U.S. Pat. No. 5,537,134; and Stathem U.S. Pat. No. 5,933,175 disclose inkjet cartridges and are incorporated by reference herein as background information for showing the same.

BACKGROUND OF THE INVENTION

The present invention is particularly applicable for use in connection with inkjet cartridges and, therefore, the invention will be described with particular reference to an inkjet cartridge. However, the invention has broader applications and may be used in connection with other products.

It is, of course, well known that a cover or protector can be used in connection with product packaging for protecting a delicate portion of a product. Further, it is also well known that the cover can be molded into a desired configuration tailored to cover and protect a desired portion of the product and to help maintain its position relative to the portion to be protected. These devices can be made from a number of different materials which provide shock absorbing qualities that protect the delicate portion of the product during the shipping and/or handling of the product. By utilizing a cover having protective qualities, a lower percentage of products are damaged during shipping and/or handling. This is especially important in relation to electronics which are easily damaged.

The problem arises in creating a protector that is inexpensive to produce and easy to position relative to the desired zone of protection. Many product protectors require separate securing items such as tape or straps to maintain the cover in the desired zone of protection.

SUMMARY OF THE INVENTION

In accordance with the present invention, a transport protector which is easy to properly install is provided for protecting the nozzle on an inkjet printer cartridge and also for preventing ink seepage from the nozzle. In this respect, a transport protector in accordance with the present invention includes a protector body having a recess shaped to at least partially receive an inkwell of the inkjet cartridge and cover the nozzle of the inkjet cartridge. The protector can further include a lid that is hingedly connected to the body and which pivots between an opened condition and a closed condition. The lid can be configured to engage the inkjet cartridge to urge the cartridge into the recess when in the closed condition and can include locking arms to releasably engage the protector body to maintain the protector in the closed condition without taping, shrink wrapping or utilize other securing methods.

A transport protector in accordance with another aspect of the present invention can include pressure ribs on the lid to evenly engage the inkjet cartridge when in the closed condition such that the nozzle evenly engages a nozzle pad in the protector.

A transport protector in accordance with yet another aspect of the invention can include a mechanism for partially ejecting the inkjet cartridge from the protector as the protector is actuated from the closed condition to the opened condition.

BRIEF DESCRIPTION OF THE DRAWINGS

The foregoing features and more will in part be obvious and in part be pointed out more fully hereinafter in connection with a written description of preferred embodiments of the present invention illustrated in the accompanying drawings in which.

DESCRIPTION OF PREFERRED EMBODIMENTS

Figure 1:
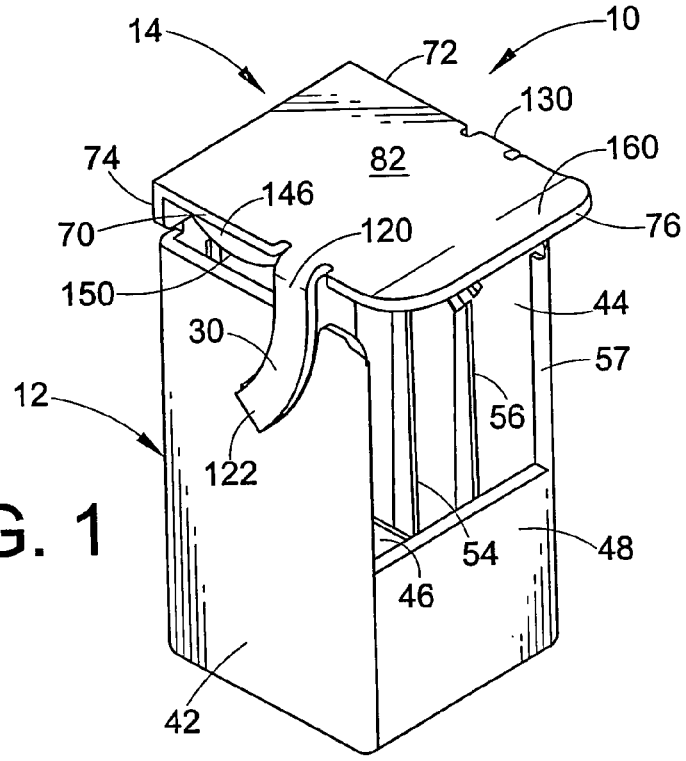
FIG. 1 is a rear perspective view of a transport protector for an inkjet cartridge in accordance with the present invention wherein the protector is in a closed condition.
Figure 2:
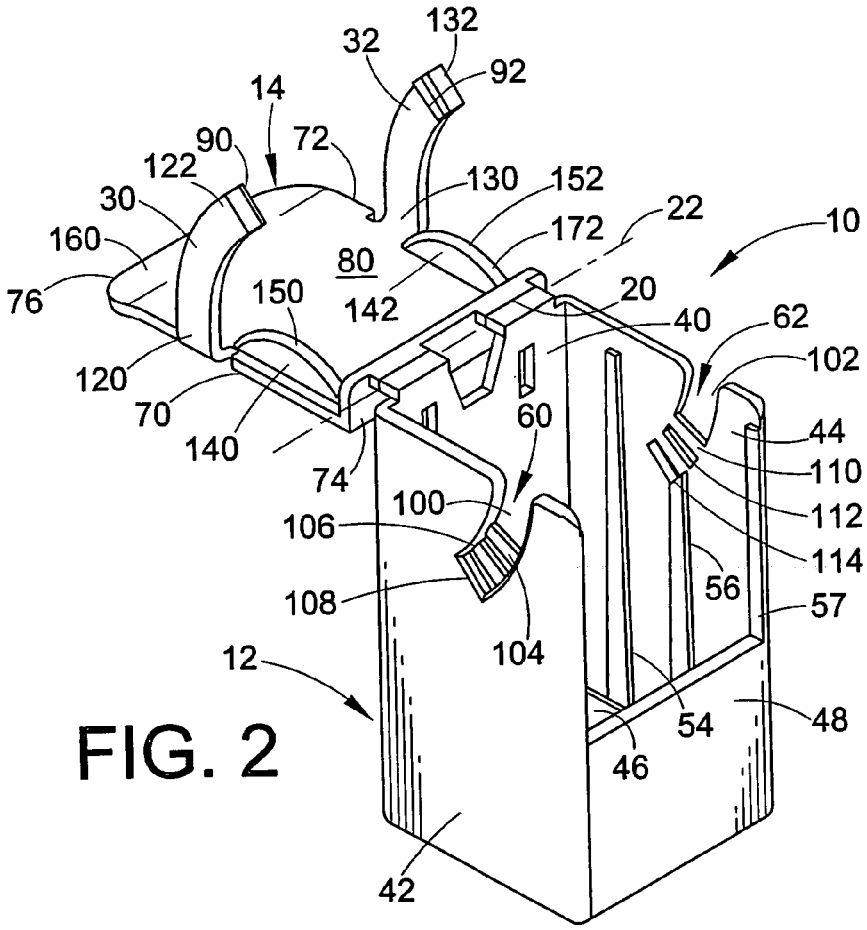
FIG. 2 is a rear perspective view of the protector shown in FIG. 1 wherein the protector is in an opened condition.

Referring now in greater detail to the drawings wherein the showings are for the purpose of illustrating preferred embodiments of the invention only and not for the purpose of limiting the invention, FIGS. 1–11 illustrate a transport protector 10 having a transport or protector body 12 and a lid 14 hingedly connected to body 12. In this respect, lid 14 is joined to body 12 at a hinge 20 wherein hinge 20, preferably, is a live hinge. However, the hinge can be any hinge known in the art to allow pivoting or hinging movement of one component relative to another component. With respect to the invention of this application, hinge 20 allows lid 14 to pivot relative to body 12 about a hinge axis 22. Furthermore, lid 14 includes a lid lock including locking arms 30 and 32 to maintain lid 14 relative to body 12 in a desired locked position or closed condition. By utilizing hinge 20 and locking arms 30 and 32, lid 14 can pivoted from the opened condition shown in FIG. 2 to the closed condition shown in FIG. 1 by rotation about hinge axis 22. Locking arms 30 and 32 maintain protector 10 in the closed condition shown in FIG. 1 which will be discussed in greater detail below. However, it should be appreciated that modifications to this locking arrangement can be made to lock lid 14 relative to body 12 without detracting from the invention. Further, as will also be discussed in greater detail below, locking arms 30 and 32 can include a ratcheting mechanism to allow the lid to lock in any one of several locking positions.

Turning to body 12, the body is configured to receive a portion of an inkjet cartridge (see FIGS. 10 and 11) to retain the cartridge in a secured condition wherein the delicate components of the inkjet cartridge are protected. As can be appreciated, the shape of protector 10 is, in large part, dictated by the configuration of the particular inkjet cartridge to be protected. In the embodiment disclosed herein, the protector is configured to protect an inkjet cartridge IC. However, protector 10 can be shaped and configured differently to work in connection with other inkjet cartridges and/or multiple cartridges.

Body 12 includes a face plate 40 with side walls 42 and 44 extending rearwardly from the side edges of the face plate. Body 12 further includes a bottom 46 extending rearwardly from face plate 40. Bottom 46 also extends between side walls 42 and 44. As discussed above, face plate 40, side wall 42, side wall 44 and bottom 46 are sized and shaped in view of the configuration of inkjet cartridge IC, and further, these components are shaped to receive an ink well (not shown) of inkjet cartridge IC along with a front portion of the inkjet cartridge. Body 12 further includes a rear wall 48 extending between sides 42 and 44 to further protect the ink well components.

Figure 11:
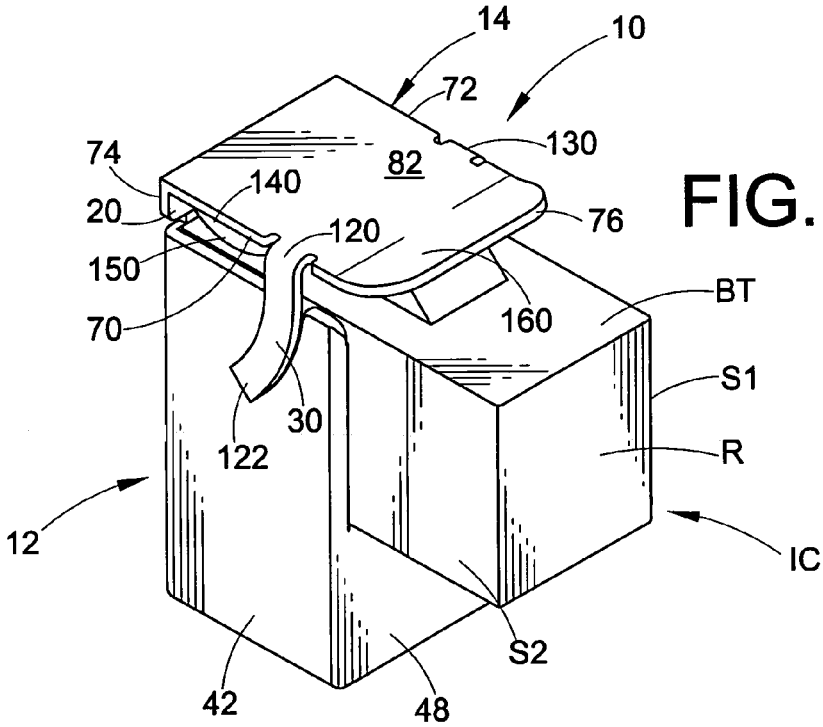

With special reference to FIG. 11, rear wall 48 is a partial wall to allow a portion of the inkjet cartridge to extend outwardly from protector 10. As can be appreciated, certain portions of the inkjet cartridge require greater protection than other portions of the cartridge. In this respect, a nozzle and flex circuits (both not shown) are a part of the operating portions of the inkjet cartridge and are generally on the ink well. The reservoir portion R is merely needed to maintain an ink supply. Therefore, cost can be reduced and the manufacturing needed to produce protector 10 can be simplified by designing protector 10 such that it is configured to provide maximum protection for only a desired group of components instead of all components of the inkjet cartridge. Protector 10 can also be utilized to help prevent ink leakage from the nozzle of inkjet cartridge IC which will be discussed in greater detail below.

Protector 10 preferably further includes reinforcing and/or protecting ribs in body 12 and/or lid 14. In this respect, side 42 includes side ribs 50, 52 and 53 and side 44 includes side ribs 54, 56 and 57. By including these ribs, protector 10 can afford a greater degree of protection for the inkjet cartridge IC by spacing sides 42 and 44 from sides S1 and S2, respectively, of inkjet cartridge IC. Further, these ribs can provide a frictional engagement with sides S1 and S2 of the inkjet cartridge IC to produce a snug fit between the protector and the inkjet cartridge without the tendency of the inkjet cartridge IC becoming wedged in body 12. While not shown, face plate 40 and rear wall 48 can also include similar ribs.

Sides 42 and 44 further include a locking arrangement for locking arms 30 and 32 of lid 14. In this respect, locking arms 30 and 32 extend toward body 12 and selectively engage a pair of locking notches 60 and 62, respectively, that are formed in sides 42 and 44. The engagement between the arms and the notches maintains lid 14 in the locked or closed condition. More particularly, lid 14 includes side edges 70 and 72 which extend from a lid base 74. Sides 70 and 72 are essentially parallel to one another and extend to a lid outer edge 76. Lid 14 further includes a bottom surface 80 and a top surface 82. Arms 30 and 32 extend downwardly from bottom surface 80. Arms 30 and 32 are at or near sides 70 and 72, respectively, and include inwardly facing locking protrusions 90 and 92, respectively, that are shaped to engage a respective one of notches 60 and 62 to create the selective locking engagement. In this embodiment, locking notches 60 and 62 are open slots having an upper opened portion 100 and 102, respectively, with one or more locking bars 104 and 106 extending transversely across the slots. The locking protrusions of arms 30 and 32 are configured to engage the bars to maintain lid 14 in the locked condition. In this respect, locking bars 104 and 106 are be spaced from one another to allow locking protrusion 90 to at least partially penetrate the opening between the bars and/or the opening between locking bar 106 and a notch base 108. In similar fashion, notch 62 includes two locking bars 110 and 112 which are spaced from one another and are spaced from a notch base 114. As can be appreciated, while two locking bars are shown for each notch, more or less than two locking bars can be utilized. However, by using more than one locking bar, and/or locking engagement point, a ratcheting action can be created that produces multiple locking positions which are helpful to account for manufacturing variances and to allow the protector to be used in connection with more than one inkjet cartridge. As a modification of the locking arrangement, locking notches 60 and 62 recesses (not shown) in the respective sides of body 12 as opposed to having open upper ends. The recesses of the notches are shaped to receive the locking protrusions and selectively maintain lid 14 relative to body 12. Further, the locking action between the locking protrusions and the notches in either case can be any known locking engagement in the art.

By utilizing notches which include open portions 100 and 102, respectively, locking protrusions 90 and 92 can be configured to penetrate these openings and engage the side walls of the inkjet cartridge IC. This configuration allows locking arms 30 and 32 to at least partially eject the inkjet cartridge from protector body 12 as the lid is opened thereby helping the end user remove the inkjet cartridge from the protector. This feature can work in connection with friction ribs such as side ribs 50, 52, 53, 54, 56 and 57 to create a packaging device that allows the user to easily remove the inkjet cartridge IC therefrom. As is stated above, ribs 50, 52, 53, 54, 56 and 57 can provide frictional engagement with the sides of inkjet cartridge IC. As protector 10 is moved from the closed condition shown in FIG. 11 to the opened condition shown in FIG. 10, locking protrusions 90 and 92 pass through upper portions 100 and 102, respectively, engage the inkjet cartridge sidewalls and partially lift the inkjet cartridge from the recess in body 12. The frictional engagement of ribs 50, 52, 53, 54, 56 and 56 can then maintain the inkjet cartridge IC in the lifted position even after protrusions 90 and 92 are released from the side walls. This feature allows the user time to grasp the inkjet cartridge IC. Further, the spacing between locking bars 104, 106, 110 and 112 discussed above along with the spacing between the bars and notch bases 108 and 114, can be such that locking protrusions 90 and 92, respectively, do not engage the sides of the inkjet cartridge IC while in the locked or closed condition.

The spacing between arms 30 and 32, and locking protrusions 90 and 92 are dictated in part by the desired function of the locking arms. As can be appreciated, if the secondary function of the arms is to lift the cartridge, the spacing of the locking protrusions must be less than the width of the cartridge. Further, even if cartridge lifting is not desired, the spacing must be calculated to create the desired selective engagement with the locking notches and to allow the remaining portions of the arm to clear the side walls of body 12.

Preferably, as shown, notches 60 and 62 are curved and arms 30 and 32 are similarly curved to improve the locking engagement therebetween. In this respect, locking arm 30 is attached to lid 14 at a base 120 that is at or near lid side 70. Arm 30 extends from base 120 to an end 122 and is curved with a radius generally equal to the distance between the locking arm and hinge axis 22. By having such a curved configuration, all portions of arm 30 are at an equal distance from the pivot point of lid 14 and are maintained at the equal distance as lid 14 pivots about axis 22. Notch 60 has a similar curved configuration. As a result, locking protrusion 90 can be maintained in transverse alignment with notch 60 and will follow the notch as the lid is pivoted relative to the body. In similar fashion, locking arm 32 can be at or near lid side 72 and can extend from an arm base 130 to an arm end 132. Locking arm 32 also includes the same curved configuration as locking arm 30 and notch 62 includes the same curved configuration as notch 60. However, it should be appreciated that arm 30 and notch 60 do not need to be identical to arms 32 and notch 62, respectively. For example, arm 30 and notch 60 can be spaced differently from axis 22 than arm 32 and notch 62 based on the configuration of the inkjet cartridge.

Figure 3:
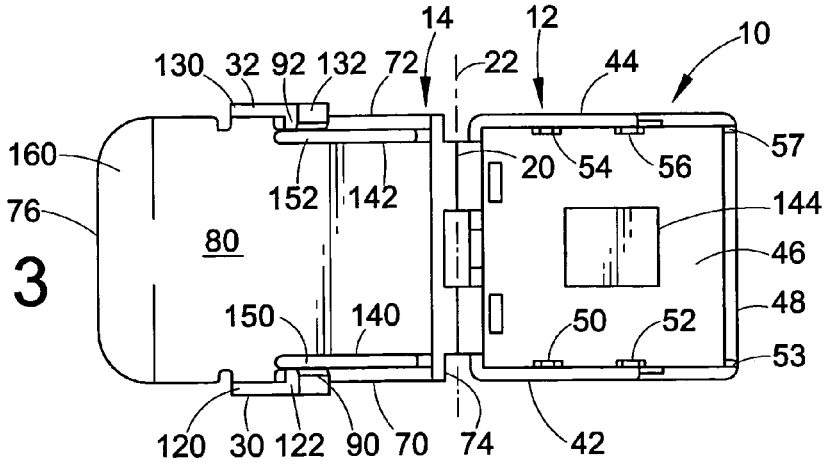
FIG. 3 is a top plan view of the protector shown in FIG. 1 shown in the opened condition.
Figure 4:
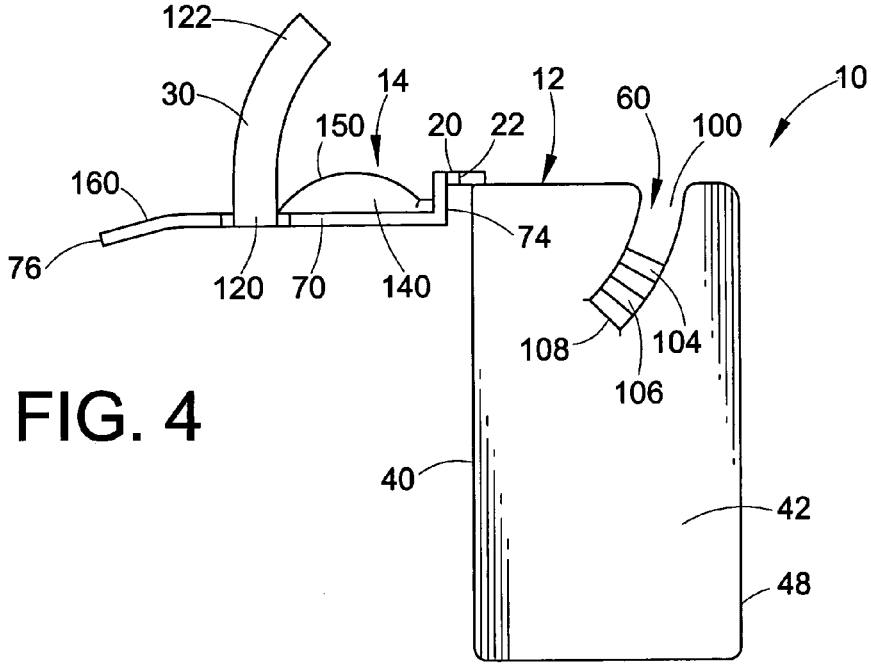
FIG. 4 is a right-side elevational view of the protector shown in FIG. 1 shown in the opened condition.
Figure 5:
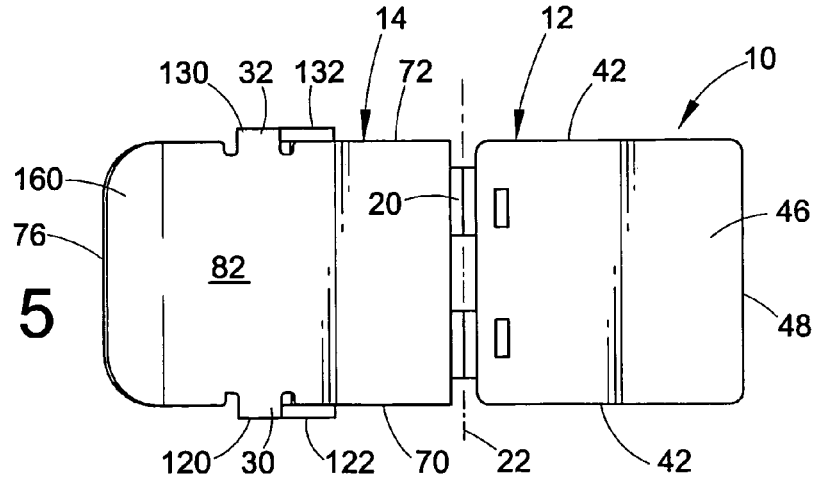
FIG. 5 is a bottom plan view of the protector shown in FIG. 1 shown in the opened condition.
Figure 6:
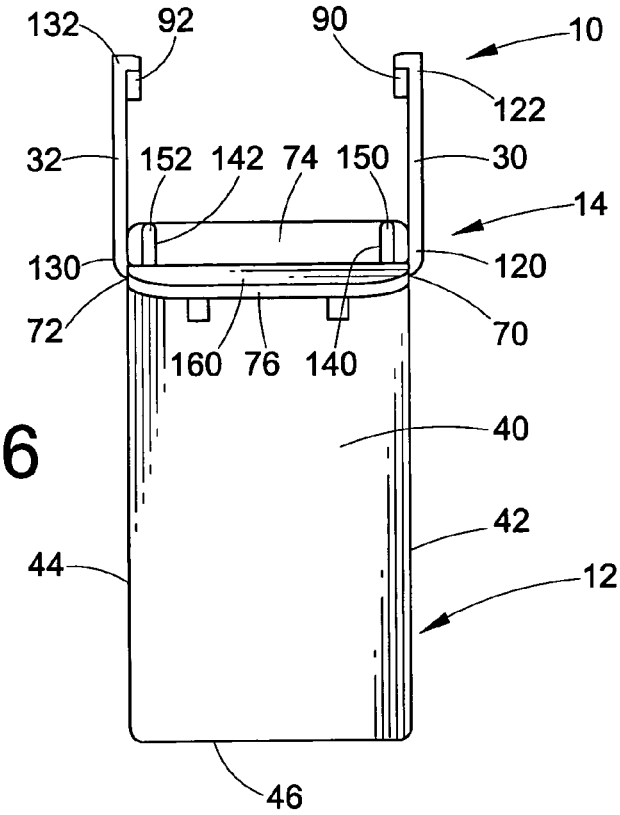
FIG. 6 is a front elevational view of the protector shown in FIG. 1 shown in the opened condition.
Figure 7:
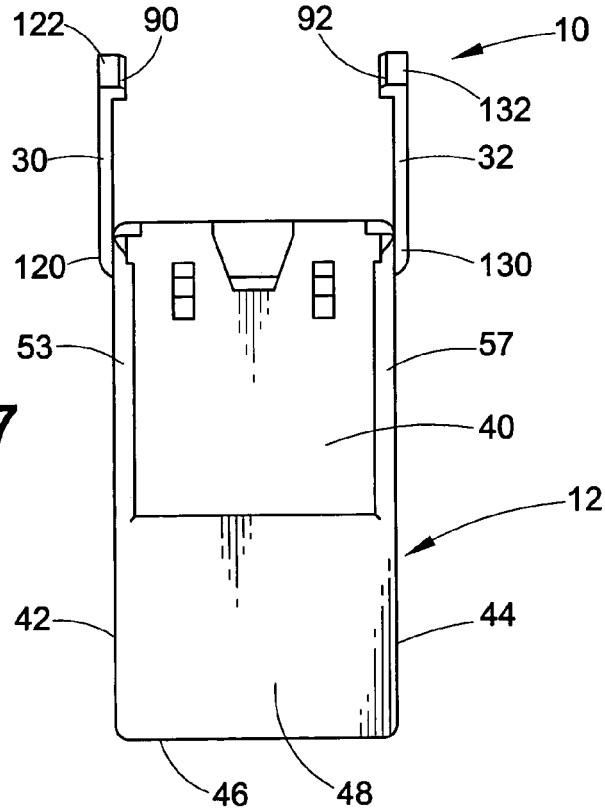
FIG. 7 is a rear elevational view of the protector shown in FIG. 1 shown in the opened condition.
Figure 8:
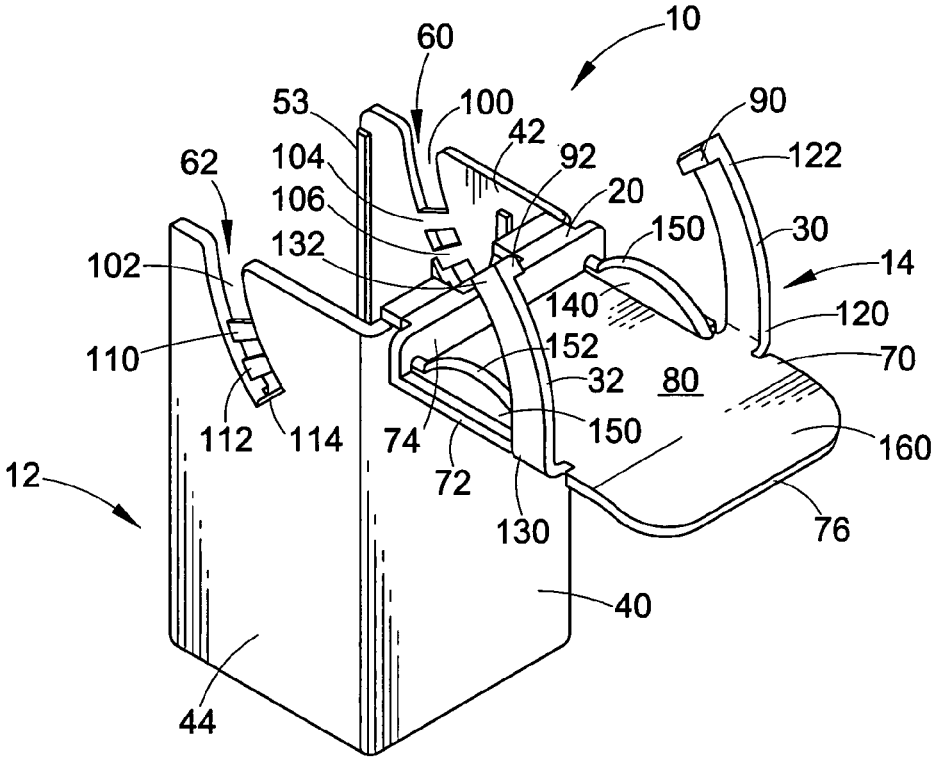
FIG. 8 is a front perspective view of the protector shown in FIG. 1 shown in the opened condition.
Figure 9:
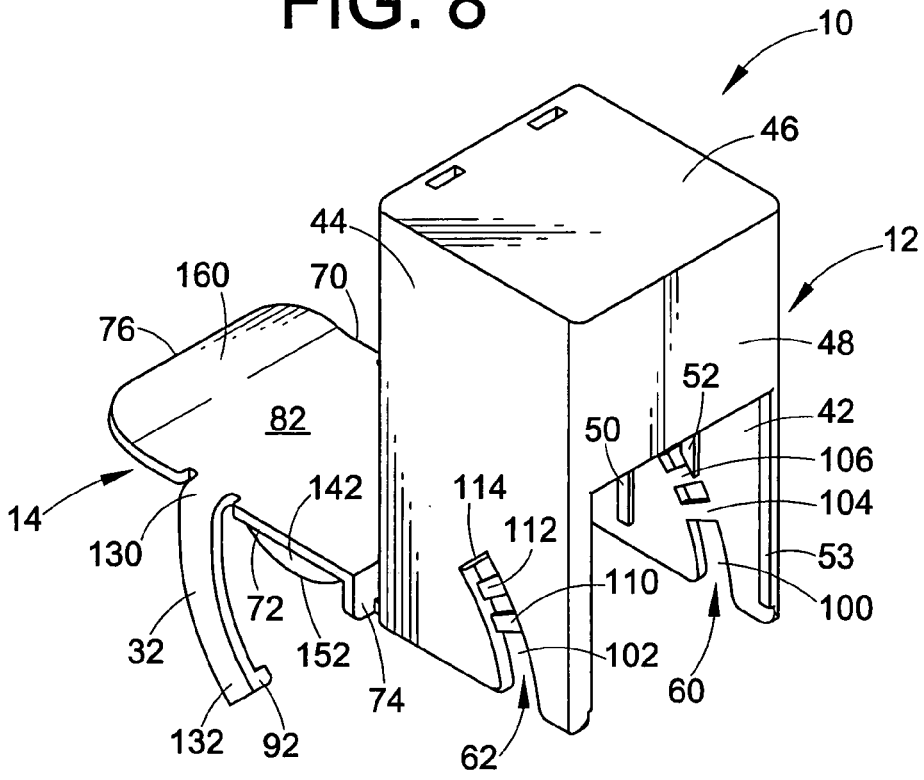
FIG. 9 is a rear bottom perspective view of the protector shown in FIG. 1 shown in the opened condition.
Figure 10:
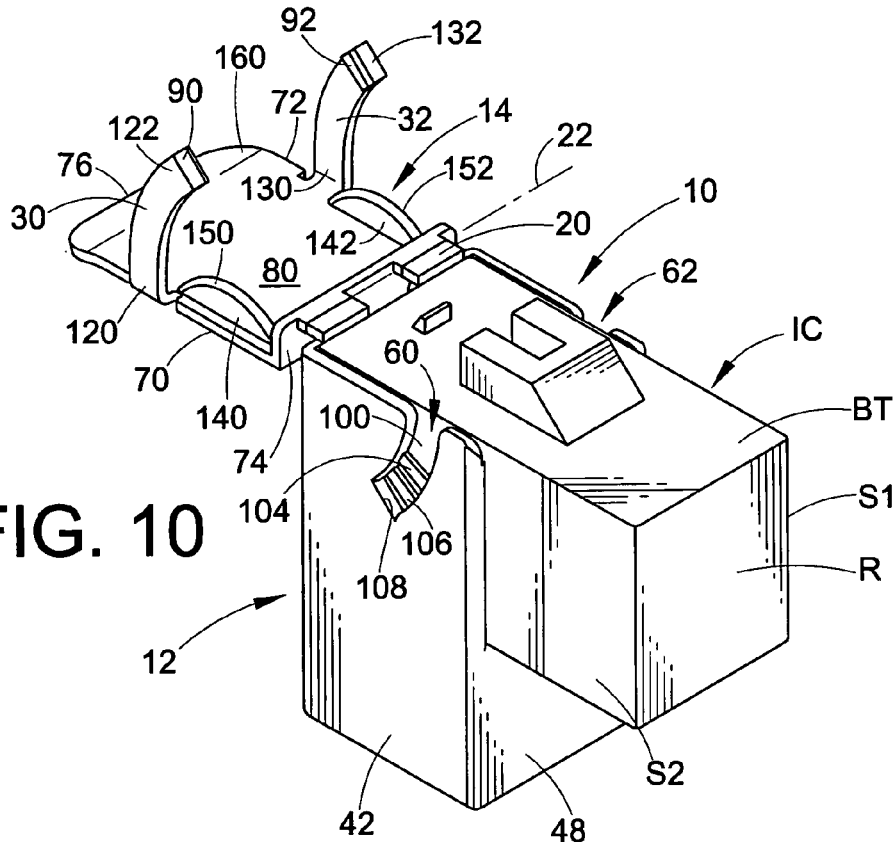
FIG. 10 is a rear perspective view of the protector shown in FIG. 1 with an inkjet cartridge in place wherein the protector is shown in the opened condition; and, FIG. 11 is a rear perspective view of the protector shown in FIG. 10 wherein the protector is in the closed condition.

Preferably, lid 14 further includes downwardly extending pressure ribs 140 and 142 to create even downward pressure or force on cartridge IC to produce an even engagement between the printer nozzle and a nozzle pad 144 on bottom 46 as shown in FIG. 3. As can be appreciated, one of the functions of protector 10 is to prevent ink leakage or seepage from the nozzle during transporting and/or shipping. As can be further appreciated, leaking or seeping is better controlled if the nozzle pad fully engages the inkjet nozzle. Further, the pad will be more effective if the engagement between the pad and the nozzle is uniform. By utilizing ribs 140 and 142, which are spaced on either side of bottom surface 80, ribs 140 and 142 engage body top BT of the cartridge on either side. This produces an even or uniform downward engagement force between lid 14 and the inkjet cartridge when protector 10 is in the closed condition. This rib arrangement also prevents rocking of the cartridge relative to protector 10. Pressure ribs 140 and 142 also include an arcuate engagement surface 150 and 152, respectively, to produce precise point contact between the respective ribs and body top BT of the inkjet cartridge IC which also accounts for variations in the manufacturing processes of the inkjet cartridge and/or protector 10. It should be appreciated that while the ribs are shown near lid sides 70 and 72, these ribs can be spaced from the side edges of the lid. As can also be appreciated, while a wider spacing is preferred, the precise spacing may be dictated by the shape of the inkjet cartridge.

Preferably, lid 14 includes a finger grip extension 160 at or near lid outer edge 76 that at least partially extends away from inkjet cartridge IC when in the closed condition. As is best shown in FIG. 11, by including finger grip 160, the user can easily grasp lid 14 and move it from the closed condition to the opened condition. As can be appreciated, the shape and configuration of the finger grip can take many forms which allow the lid to be easily engaged by the user of the inkjet cartridge. Further, finger grip 160 does not need to be adjacent or near outer edge 76. In this respect, finger grip 160 can extend from any portion of the lid which allows the user to easily actuate the lid from the closed condition to the opened condition and vise-versa.

While considerable emphasis has been placed on the preferred embodiments of the invention illustrated and described herein, it will be appreciated that other embodiments can be made and that many changes can be made in the preferred embodiments without departing from the principals of the invention. It is intended to include all such modifications and alterations insofar as they come within the scope of the appended claims or the equivalents thereof.

The invention claimed is:

1. A transport protector for an inkjet cartridge, the inkjet cartridge including a cartridge body with an inkwell extending from the cartridge body and a nozzle on the inkwell, said protector comprising a protector body including a recess shaped to at least partially receive an inkwell of an inkjet cartridge and a lid hingedly connected to said body, said lid pivoting between an opened condition and a closed condition, said lid engaging the inkjet cartridge to urge the cartridge into said recess when in said closed condition, and said lid including a lid lock that releasably engages said protector body to maintain said protector in said closed condition, wherein said lid lock is adjustable.

2. The protector of claim 1, wherein said protector is a unified molded component.

3. The protector of claim 1, wherein said protector body further includes a face plate and side walls extending from either side of said face plate, said face plate and side walls shaped to matingly receive a portion of the body of a cartridge of an inkjet cartridge.

4. The protector of claim 3, wherein said protector body further includes a bottom extending from said face plate and between said sides, said bottom and said sides forming a portion of said recess, said bottom including a nozzle pad positioned to be engaged by and to cover the nozzle of an inkjet cartridge in said protector.

5. The protector of claim 3, wherein said protector body further includes a bottom extending from said face plate and between said sides, said bottom and said sides forming a portion of said recess.

6. The protector of claim 5, wherein said protector body further includes a back wall extending between said sides, said back wall forming a portion of said recess such that said face plate, said sides and said back wall substantially cover the inkwell of a cartridge in said protector.

7. The protector of claim 6, wherein said recess further includes a pad on said bottom, said pad engaging the nozzle of an inkjet cartridge when said protector is in said closed condition.

8. The protector of claim 1, wherein said lid lock includes at least one locking arm extending from said lid, said at least one locking arm having a locking protrusion for engaging said protector body and selectively maintaining said lid relative to said body in said closed condition.

9. The protector of claim 8, wherein said at least one locking arm is arcuate and said protector body includes at least one notch for receiving said locking protrusion.

10. The protector of claim 9, wherein said at least one locking arm is a ratcheting locking arm capable of engaging said protector body in more than one position.

11. The protector of claim 9, wherein said lid is hingedly connected to said protector body at a lid base and said lid includes a first and a second side extending from said base, said at least one locking arm including a first and a second locking arm and said locking protrusion being a first and a second lock protrusion, said first locking arm being joined to said lid near said first side and includes said first locking protrusion, said second locking arm being joined to said lid near said second side and includes said second locking protrusion, said protector body further including a face plate and side walls extending from either side of said face plate, said side walls each including at least one notch shaped to receive and selectively retain a respective one of said first and second locking protrusions.

12. The protector of claim 11, wherein said first and second locking arms are ratcheting locking arms capable of engaging said protector body in more than one position.

13. The protector of claim 11, wherein said lid has a bottom surface including at least one pressure rib and said protector body includes a nozzle pad, said at least one pressure rib engaging the inkjet cartridge when in said closed condition such that the nozzle of the inkjet cartridge engages said nozzle pad evenly.

14. The protector of claim 13, wherein said at least one pressure rib includes two pressure ribs.

15. The protector of claim 13, wherein said at least one pressure rib includes an arcuate engagement surface.

16. The protector of claim 1, wherein said lid has a bottom surface including at least one pressure rib and said protector body includes a nozzle pad, said at least one pressure rib engaging the inkjet cartridge when in said closed condition such that the nozzle of the inkjet cartridge engages said nozzle pad evenly.

17. The protector of claim 16, wherein said at least one pressure rib includes two pressure ribs.

18. The protector of claim 16, wherein said at least one pressure rib includes an arcuate engagement surface.

19. The protector of claim 1, further includes a pad in said recess for sealing a nozzle on the cartridge when said protector is in said closed condition.

20. The protector of claim 1, wherein said lid lock includes locking protrusions for partially lifting the inkjet cartridge from said recess when said lid moves from said closed condition to said opened condition.

21. The protector of claim 1, wherein said lid lock includes at least one locking arm extending from said lid, said at least one locking arm having a locking protrusion for engaging said protector body and maintaining said lid relative to said body in said closed condition, said locking protrusion engaging the cartridge body of the inkjet cartridge as said protector is actuated from said closed condition to said opened condition to partially lift the cartridge relative to said protector body.

22. The protector of claim 21, wherein said at least one locking arm is two locking arms, each having said locking protrusion and said locking protrusions facing one another.

23. The protector of claim 1, wherein said lid further includes a finger grip extending away from the inkjet cartridge when in said closed condition.

24. A transport protector for an inkjet cartridge, the inkjet cartridge including a cartridge body, an inkwell extending from the cartridge body and a nozzle on the inkwell, said protector comprising a protector body including a recess for receiving an inkwell of an inkjet cartridge and a nozzle pad to cover a nozzle of the inkjet cartridge, said protector further including a lid hingedly connected to said body such that said lid pivots between an opened condition and a closed condition, said lid having a bottom surface including at least one pressure rib that engages the inkjet cartridge when in said closed condition such that the nozzle engages said nozzle pad evenly.

25. The protector of claim 24, wherein said at least one pressure rib includes two pressure ribs.

26. The protector of claim 24, wherein said at least one pressure rib includes an arcuate engagement surface.

27. The protector of claim 26, wherein said at least one pressure rib includes two pressure ribs.

28. The protector of claim 24, further including at least one locking arm extending from said lid, said at least one locking arm having a locking protrusion for engaging said protector body and selectively maintaining said lid relative to said body in said closed condition.

29. The protector of claim 28, wherein said at least one locking arm is arcuate and said protector body includes at least one arcuate notch for receiving said locking protrusion.

30. The protector of claim 28, wherein said lid is hingedly connected to said protector body at a lid base and said lid includes a first and a second side extending from said base, said at least one locking arm including a first and a second locking arm and said locking protrusion being a first and a second locking protrusion, said first locking arm being joined to said lid near said first side and including said first locking protrusion, said second locking arm being joined to said lid near said second side and including said second locking protrusion, said side walls each including a locking notch shaped to receive and selectively retain a respective one of said first and second locking protrusions, said locking notches including an open portion to allow said respective protrusions to pass through a respective said side wall.

31. The protector of claim 24, wherein said lid further includes a finger grip extending away from the inkjet cartridge when in said closed condition.

32. The protector of claim 24, further including at least one locking arm extending from said lid, said at least one locking arm having a locking protrusion for engaging said protector body and selectively maintaining said lid relative to said body in said closed condition, said at least one locking arms being a ratcheting locking arm capable of engaging said protector body in more than one position.

33. The protector of claim 24, further including at least one locking arm extending from said lid, said at least one locking arm having a locking protrusion for engaging said protector body and selectively maintaining said lid relative to said body in said closed condition, said locking protrusions of said at least one locking arms engaging the inkjet cartridge allowing said protrusions to partially lift the inkwell from said recess.

34. The protector of claim 33, wherein said locking protrusions of said at least one locking arm engages the cartridge body of the inkjet cartridge as said protector is actuated from said closed condition to said opened condition for said lifting.

35. The protector of claim 33, wherein said protector body includes a notch opening and said locking protrusions pass partially through said open notch.

36. A transport protector for an inkjet cartridge, the inkjet cartridge including a cartridge body, an inkwell extending from the cartridge body and a nozzle on the inkwell, said protector comprising a protector body including a recess for receiving an inkwell of an inkjet cartridge and a nozzle pad to cover a nozzle of the inkjet cartridge, a lid hingedly connected to said body such that said lid pivots between an opened condition and a closed condition, and a lid lock which engages the inkjet cartridge to partially lift the cartridge from said protector body as said protector is actuated from said closed condition to said opened condition.

37. The protector of claim 36, wherein said lid lock includes at least one locking arm extending from said lid, said at least one locking arm having a locking protrusion for engaging said protector body to selectively maintain said lid relative to said protector body in said closed condition, said at least one locking arms performing said lifting.

38. The protector of claim 37, wherein said protector body includes a notch opening notch and said locking protrusions pass partially through said notch opening.

39. The protector of claim 37, wherein said locking protrusions engage the cartridge body for said partial lifting.

* * * * *